US010047739B2

(12) United States Patent
Yin

(10) Patent No.: US 10,047,739 B2
(45) Date of Patent: Aug. 14, 2018

(54) PUMP JACK SYSTEM AND METHOD

(71) Applicant: Zedi Canada Inc., Edmonton (CA)

(72) Inventor: Minhao Yin, Calgary (CA)

(73) Assignee: Zedi Canada Inc. (CA)

( * ) Notice: Subject to any disclaimer, the term of this patent is extended or adjusted under 35 U.S.C. 154(b) by 638 days.

(21) Appl. No.: 14/588,276

(22) Filed: Dec. 31, 2014

(65) Prior Publication Data

US 2016/0186537 A1 Jun. 30, 2016

(51) Int. Cl.
*F04B 47/14* (2006.01)
*E21B 43/12* (2006.01)

(52) U.S. Cl.
CPC ..... *F04B 47/145* (2013.01); *E21B 43/126* (2013.01)

(58) Field of Classification Search
CPC ... E21B 43/126; E21B 43/129; E21B 17/1071
See application file for complete search history.

(56) References Cited

U.S. PATENT DOCUMENTS 3,556,212 A * 1/1971 Gonzalo Vazquez . E21B 34/063 137/467
3,632,234 A 1/1972 Lake
3,777,491 A 12/1973 Bender
3,986,564 A 10/1976 Bender
4,198,820 A 4/1980 Roth et al.
4,221,124 A * 9/1980 Jones ..... G01M 3/26 425/33
4,380,150 A 4/1983 Carlson
4,392,792 A 7/1983 Rogers
4,400,141 A 8/1983 Lee et al.
4,512,149 A 4/1985 Weaver
4,516,473 A * 5/1985 Oneyama ..... B66F 7/16 60/372
4,546,607 A 10/1985 Kime
4,691,511 A 9/1987 Dollison
4,698,968 A 10/1987 Mestieri
4,707,993 A 11/1987 Kime
(Continued)

FOREIGN PATENT DOCUMENTS

WO 2010141405 3/2011

OTHER PUBLICATIONS

Markham Hislop, Ecoquip—A Story of Innovation and Perseverance: A Better Pump Jack is Here, Sep. 18, 2013, p. 3, Jun. 2013 Issue, Oilfield Pulse.

(Continued)

*Primary Examiner* — Giovanna C. Wright
*Assistant Examiner* — Manuel C Portocarrero
(74) *Attorney, Agent, or Firm* — Jones Walker LLP

(57) ABSTRACT

A pump jack system for vertically reciprocating a downhole pump in an oil and gas well. The pump jack system includes a cylinder assembly having a drive cylinder and two balance cylinders. A piston in the drive cylinder may be used to provide an upstroke of a sucker rod string of a downhole pump. The pistons in the balance cylinders may be used to provide a downstroke of the sucker rod string. Lower chambers in the balance cylinders counterbalance the lifting and lowering of the piston in the drive cylinder. The pump jack system also includes an accumulator for maintaining a relative constant fluid pressure in the lower chambers of the balance cylinders.

27 Claims, 13 Drawing Sheets

(56) References Cited

U.S. PATENT DOCUMENTS

| | | | | |
|---|---|---|---|---|
| 4,762,473 | A | 8/1988 | Tieben | |
| 5,145,332 | A | 9/1992 | Bohon | |
| 5,536,150 | A | 7/1996 | Tucker | |
| 5,996,688 | A | 12/1999 | Schulz et al. | |
| 7,530,799 | B2 | 5/2009 | Smith | |
| 8,336,613 | B2 | 12/2012 | Ramsey et al. | |
| 2002/0129755 | A1 | 9/2002 | Hagen et al. | |
| 2007/0144595 | A1* | 6/2007 | Geva | F16K 1/123 137/625.48 |
| 2008/0000632 | A1* | 1/2008 | Brecheisen | E21B 43/126 166/72 |
| 2010/0300679 | A1 | 12/2010 | Lorimer et al. | |
| 2011/0227014 | A1 | 9/2011 | Lautzenhiser et al. | |
| 2012/0328457 | A1* | 12/2012 | Brown | F04B 47/04 417/375 |
| 2013/0343928 | A1 | 12/2013 | McCarthy | |
| 2014/0014318 | A1 | 1/2014 | Mail | |

OTHER PUBLICATIONS

Weatherford, Pumping Units—Reciprocating Rod-Lift Systems, 2010, p. 13, Retrieved from: http://www.weatherford.com/dn/WWW018972.

Nov Mono, Rod Pump Systems, 2013, p. 4-5, Retrieved from: http://www.nov.com/uploadedFiles/Business_Groups/Distribution/Artificial_Lift/Hydraulic_Rod_Pumping_Systems/NOV-Mono-Rod-Pump-Systems.pdf.

* cited by examiner

PUMP JACK SYSTEM AND METHOD

BACKGROUND OF THE INVENTION

For over a century in the oil and gas industry, most downhole fluid is pumped using conventional pump jack systems. These conventional systems require large transportation costs due to their tremendous weights and sizes. Conventional pump jack systems also encounter difficulties in controlling operating parameters, difficulties in system adjustments, and high installation costs. Adjustments to the conventional pumping units involve separately adjusting stroke length, upstroke speed, and downstroke speed, which requires manpower and a lift crane to pin and unpin the shaft and to adjust counterweight positions. These adjustments are costly and involve safety risks.

Most hydraulic pump jack drive systems directly lift both the rod string and fluid head inside the tubing string, which consumes a large amount of power. These systems are typically used for low production margin wells. Certain hydraulic pump jack systems save energy via $N_2$ counterweight systems, but stroke length and seal life are reduced in these systems for high speed operations.

Desirable improvements to pump jack systems include decreased weight and size, ease of controlling the system remotely, and increased power, system efficiency, and reliability of the drive.

DETAILED DESCRIPTION OF THE PREFERRED EMBODIMENTS

A pump jack system may be used for reciprocating a down hole pump via a sucker rod string in an oil and gas well. The pump jack system may include a cylinder assembly for providing upward and downward movement of the sucker rod string. The cylinder assembly may be mounted directly above a wellhead of the oil and gas well. Alternatively, the cylinder assembly may be mounted near the wellhead. In this embodiment, the pump jack system may further include a sheave assembly connected to the cylinder assembly, with the sheave assembly having a carrier assembly disposed above the wellhead.

Figure 1:
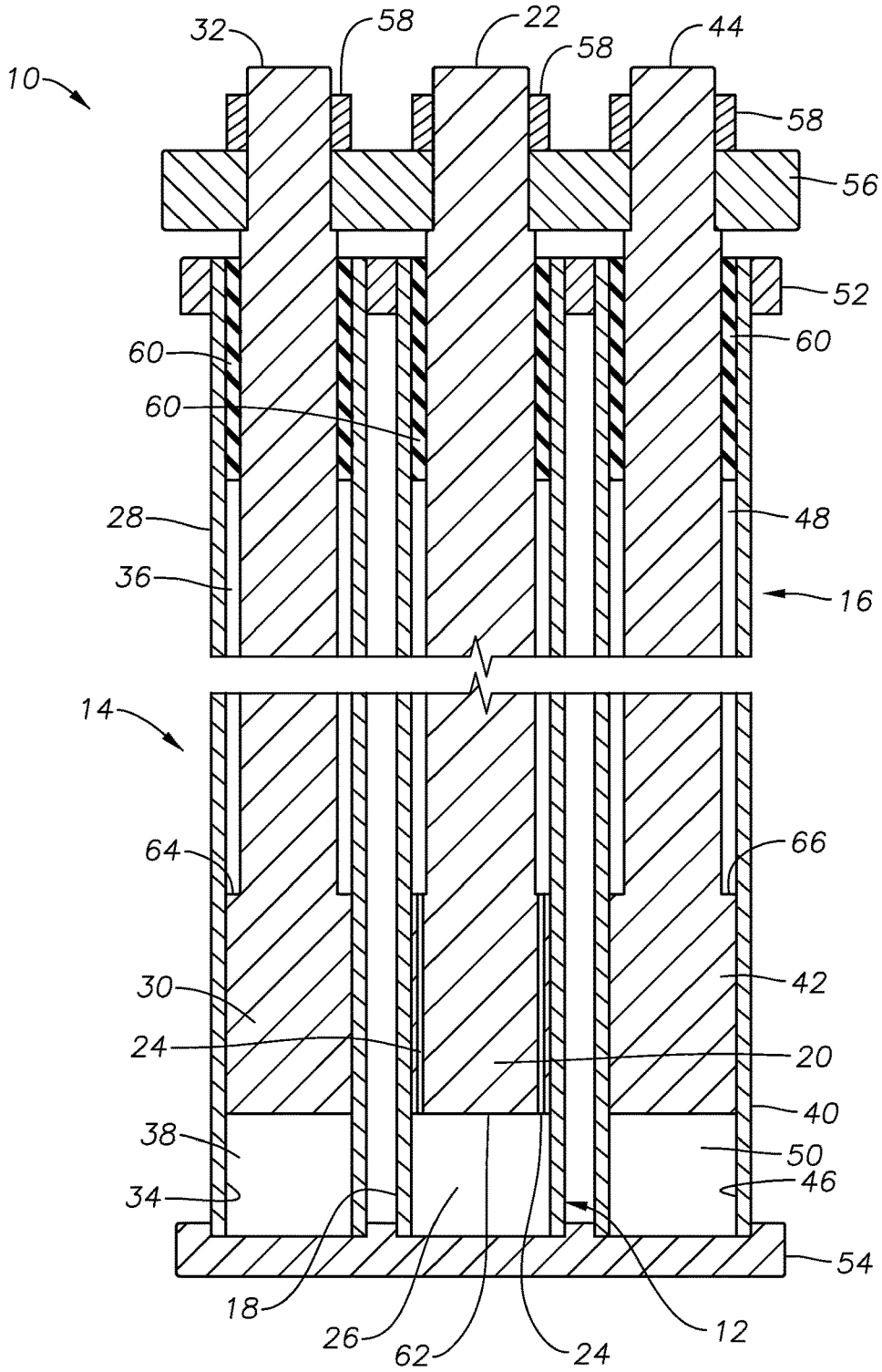
FIG. 1 is a cross-sectional view of a cylinder assembly of a pump jack system.

FIG. 1 illustrates cylinder assembly 10 of a pump jack system. Cylinder assembly 10 may include drive cylinder 12 and balance cylinder 14 and 16. Drive cylinder 12 may include drive barrel 18 and drive piston 20 having drive rod 22. Drive piston 20 may include fluid passages 24 for allowing fluid communication across drive piston 20 within drive chamber 26. Balance cylinder 14 may include balance barrel 28 and balance piston 30 having balance rod 32. Balance piston 30 may form a fluid tight seal with inner surface 34 of balance barrel 28 such that balance piston 30 fluidly separates upper balance chamber 36 and lower balance chamber 38 of balance cylinder 14. Balance cylinder 16 may include balance barrel 40 and balance piston 42 having balance rod 44. Balance piston 42 may form a fluid tight seal with inner surface 46 of balance barrel 40 such that balance piston 42 fluidly separates upper balance chamber 48 and lower balance chamber 50 of balance cylinder 16.

In one embodiment, drive piston 20 may be integrally formed with a lower end of drive rod 22. Similarly, balance pistons 30 and 42 may be integrally formed with lower ends balance rods 32 and 44, respectively. Alternatively, drive piston 20 and balance pistons 30, 42 may each be securely affixed to lower ends of drive rod 22 and balance rods 32, 44, respectively, such as by bolted connection or any other connection mechanism capable of securely fastening drive piston 20 to drive rod 22.

Upper ends of drive barrel 18 and balance barrels 28 and 40 may be fixed to upper cross member 52, and lower ends of drive barrel 18 and balance barrels 28 and 40 may be fixed to lower cross member 54. Upper and lower cross members 52 and 54 secure barrels 18, 28, and 40 in a fixed arrangement. In one embodiment, drive barrel 18 is disposed between balance barrels 28 and 40. Upper ends of drive rod 22 and balance rods 32 and 44 may be connected to rod cross member 56, such as with nuts 58. Rod cross member 56 rigidly connects drive rod 22 to balance rods 32 and 44 such that pistons 20, 30, 42 move in tandem within barrels 18, 28, 40, respectively. Seal members 60 are disposed within the annular space between rods 22, 32, 44 and the upper ends of barrels 18, 28, 40, respectively. Seal members 60 provide a fluid seal for drive chamber 26 and upper balance chambers 36 and 48.

In one embodiment, a net lifting area of drive chamber 26 may be equal to or nearly equal to a net lowering area of upper balance chambers 36 and 48 of balance cylinders 14 and 16. In other words, the area of lower surface 62 of drive piston 20 is approximately equal to the sum of the areas of upper surface 64 of balance piston 30 and upper surface 66 of balance piston 42.

Figure 2:
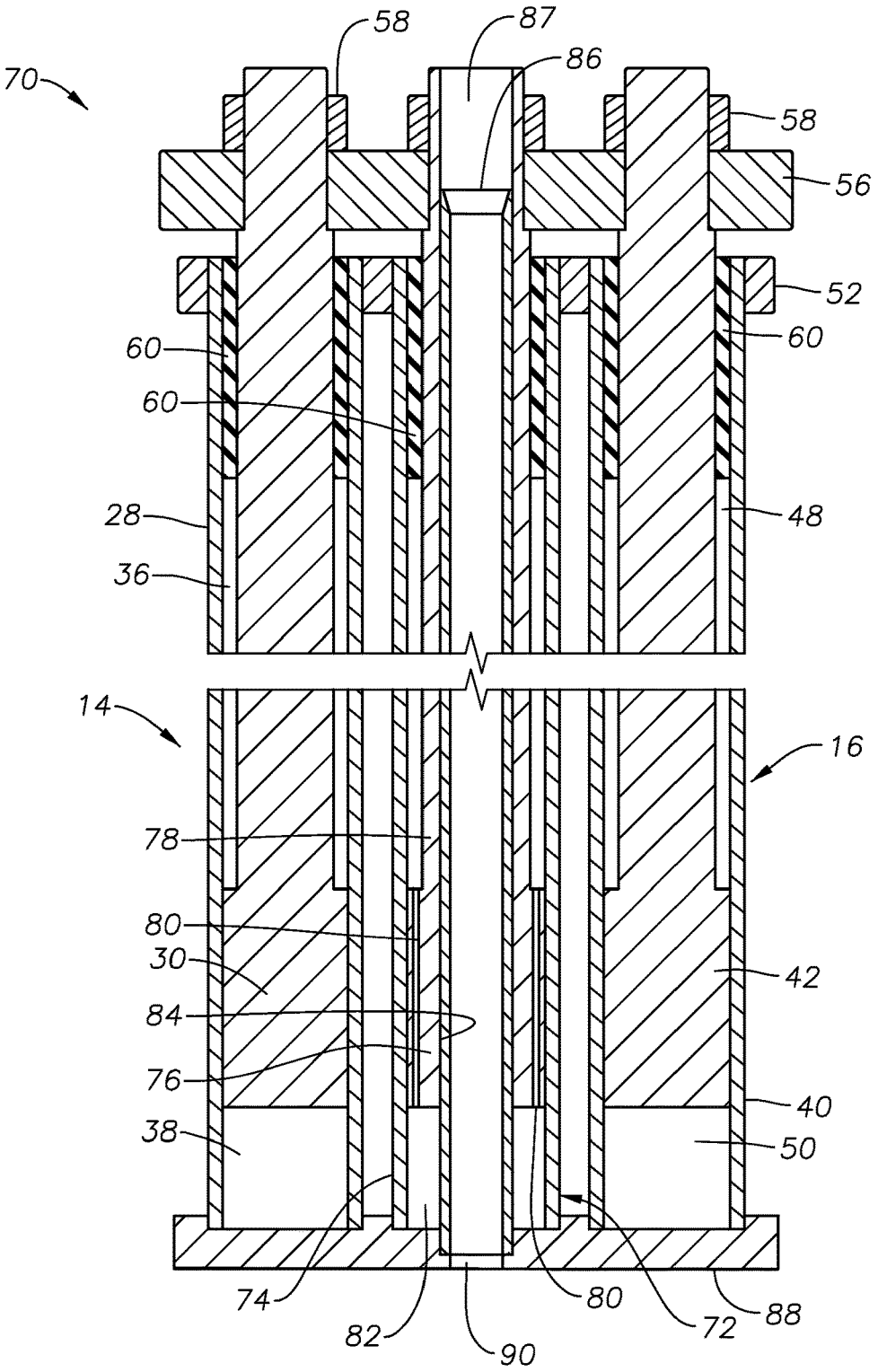
FIG. 2 is a cross-sectional view of an alternate embodiment of the cylinder assembly.

FIG. 2 illustrates an alternate embodiment of the cylinder assembly. Cylinder assembly 70 includes drive cylinder 72 and balance cylinders 14 and 16. It should be noted that like numbers in the various figures of this application refer to like components, even in alternate embodiments. Drive cylinder 72 may include drive barrel 74 and drive piston 76 having drive rod 78. Drive piston 76 may include fluid passages 80 for allowing fluid communication across drive piston 76 within drive chamber 82. Axial bore 84 may extend through drive rod 78 and drive piston 76. Sealing tubular 86 having sealed bore 87 may extend through a substantial length of axial bore 84 in order to fluidly separate axial bore 84 from drive chamber 82. In this embodiment, lower ends of barrels 72, 28, 40 may be fixed to lower cross member 88. The lower end of sealing tubular 86 may also be affixed to lower cross member 88. In this way, barrels 72, 28, 40 and sealing tubular 86 are secured in a fixed arrangement. Lower cross member 88 may include aperture 90 in fluid communication with sealing tubular 86. Sealed bore 87 and aperture 90 may each be dimensioned to allow movement of a sucker rod string and sucker rod couplings, such as API sucker rod couplings. Sealed bore 87 and aperture 90 may allow cylinder assembly 70 to be directly mounted above a wellhead of an oil and gas well.

Figure 3:
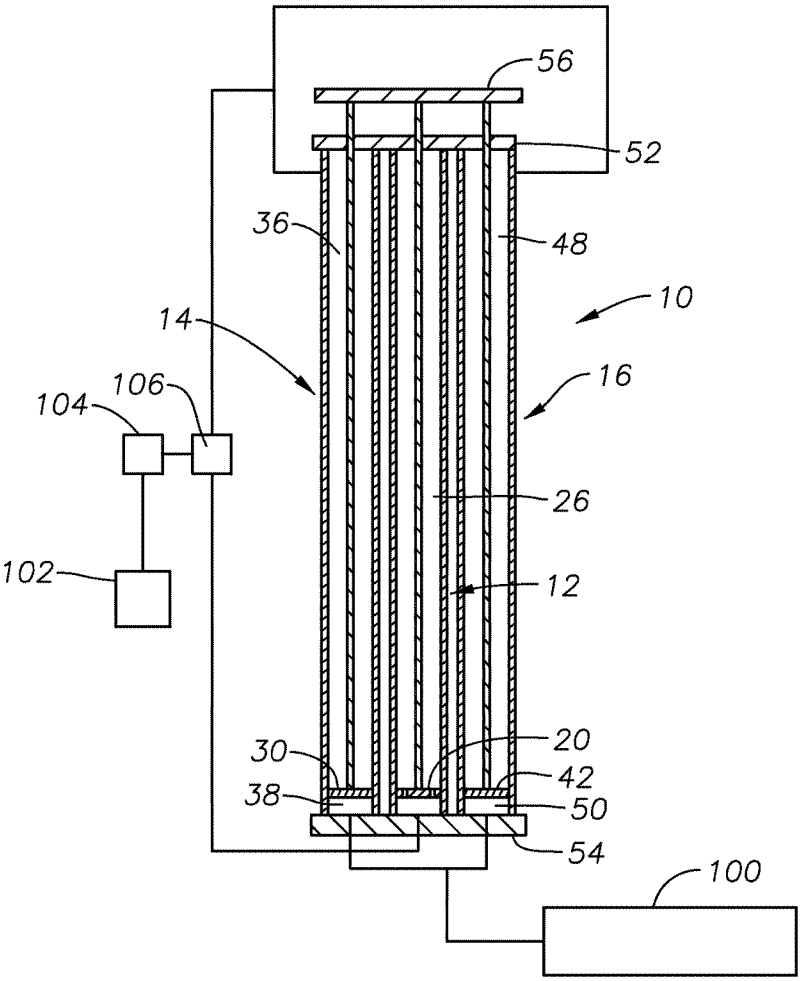
FIG. 3 is a schematic view of a cylinder assembly used with a bladder accumulator of the pump jack system.

FIG. 3 is a schematic illustration of cylinder assembly 10 with bladder accumulator 100. Bladder accumulator 100 may be in fluid communication with lower balance chambers 38 and 50. Bladder accumulator 100 may be configured to provide a fluid to lower balance chambers 38 and 50 with a relative constant pressure. Drive chamber 26 may be in fluid communication with fluid reservoir 102 through pump 104 and valve 106. Upper balance chambers 36 and 48 may also be in fluid communication with fluid reservoir 102 through pump 104 and valve 106.

Pumping fluid from fluid reservoir 102 into drive chamber 26 may push drive piston 20 upward. Upward movement of drive piston 20 lifts rod cross member 56 and balance pistons 30 and 42 by the same distance. As balance pistons 30 and 42 are lifted, fluid may be transferred from bladder accumulator into lower balance chambers 38 and 50 due to the pressure differential caused by balance pistons 30 and 42 being lifted. Fluid may also be displaced from upper balance chambers 36 and 48 through upper balance ports (described below) with upward movement of balance pistons 30 and 42.

Discontinuing the pumping of fluid into drive chamber 26 and pumping fluid from fluid reservoir 102 into upper balance chambers 36 and 48 may push balance pistons 30 and 42 downward. Downward movement of balance pistons 30 and 42 transfers fluid from lower balance chambers 38 and 50 back into bladder accumulator 100. Forced downward movement of balance pistons 30 and 42 pulls drive piston 20 downward by the same distance due to rod cross member 56. Fluid passages 24 facilitate the downward movement of drive piston 20. With the downward movement of drive piston 20, fluid may be displaced from drive chamber 26 through a drive port (described below). Because of the fluid connections between upper balance chambers 36 and 48 and the fluid connections between lower balance chambers 38 and 50, cylinder assembly 10 may functionally have three chambers: first, drive chamber 26 for providing upward displacement of pistons 20, 30, 42; second, lower balance chambers 38, 50 for counterbalance purposes; and third, upper balance chambers 36, 48 for providing downward displacement of pistons 20, 30, 42. It should be noted that cylinder assembly 70, which includes drive rod 78 having axial bore 84, may be used with bladder accumulator 100.

Figure 4:
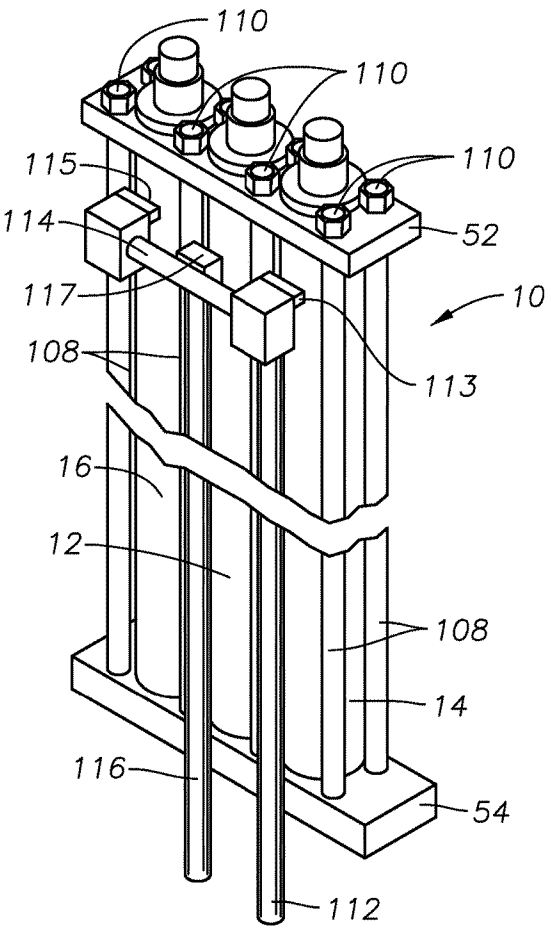
FIG. 4 is a perspective view of the cylinder assembly of FIG. 3.
Figure 5:
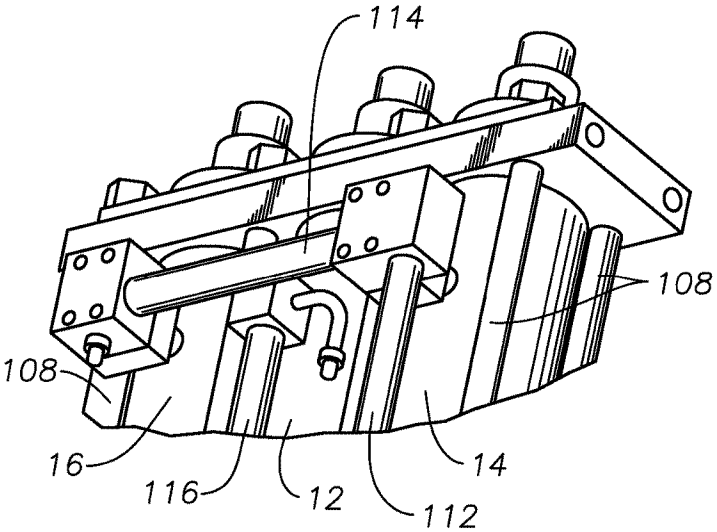
FIG. 5 is a partial perspective view of the cylinder assembly of FIG. 3.

With reference to FIGS. 4 and 5, cylinder assembly 10 may also include tie rods 108, each having an end affixed to upper cross member 52 and another end affixed to lower cross member 54. Tie rods 108 may be affixed to upper and lower cross members 52, 54 with nuts 110. Balance supply line 112 may be in fluid communication with fluid reservoir 102 and pump 104. Balance supply line 112 may feed into upper balance chamber 36 through upper balance port 113. Balance supply line 112 may feed into upper balance chamber 48 through connecting line 114 and upper balance port 115. Drive supply line 116 may feed into drive chamber 26 through drive port 117.

The fluid pumped from fluid reservoir 102 into drive chamber 26 or 82 and upper balance chambers 36, 48 may be a hydraulic fluid. The fluid pumped from bladder accumulator 100 into lower balance chambers 38, 50 may be a hydraulic fluid.

Figure 6:
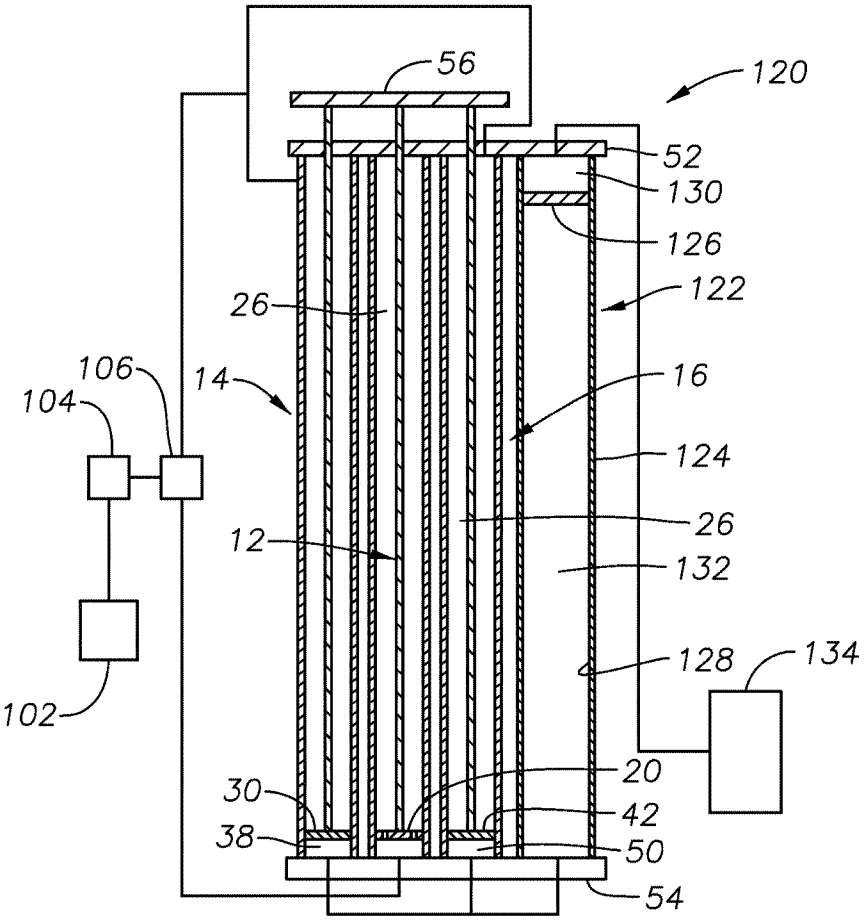
FIG. 6 is a schematic view of a cylinder assembly used with an accumulator cylinder of the pump jack system.

FIG. 6 is a schematic illustration of cylinder assembly 120 with accumulator cylinder 122 for providing a fluid to lower balance chambers 38 and 50 with a relative constant pressure. Accumulator cylinder 122 may include accumulator barrel 124 and accumulator piston 126. Accumulator piston 126 may form a fluid tight seal with inner surface 128 of accumulator barrel 124 such that accumulator piston 126 fluidly separates upper accumulator chamber 130 and lower accumulator chamber 132 of accumulator cylinder 122. Lower accumulator chamber 132 may be in fluid communication with lower balance chambers 38 and 50. Upper accumulator chamber 130 may be in fluid communication with supply unit 134. An upper end of accumulator cylinder 122 may be affixed to upper cross member 52, and a lower end of accumulator cylinder 122 may be affixed to lower cross member 54. Alternatively, the upper and lower ends of accumulator cylinder 122 may be affixed to upper and lower accumulator cross members that are connected to upper and lower cross members 52, 54.

In this embodiment, upward movement of drive piston 20 may cause upward movement of balance pistons 30 and 42. This upward movement of balance pistons 30 and 42 may cause fluid to be transferred from lower accumulator chamber 132 into lower balance chambers 38 and 50 due to the pressure differential created by movement of balance pistons 30 and 42. Fluid transfer out of lower balance chambers 38 and 50 may cause downward movement of accumulator piston 126 and fluid movement from supply unit 134 into upper accumulator chamber 130 due to the pressure differential created by movement of accumulator piston 126. Downward movement of drive piston 20 and balance pistons 30 and 42 may cause fluid to be returned from lower balance chambers 38 and 50 into lower accumulator chamber 132, upward movement of accumulator piston 126, and fluid transfer from upper accumulator chamber 130 into supply unit 134.

Figure 7:
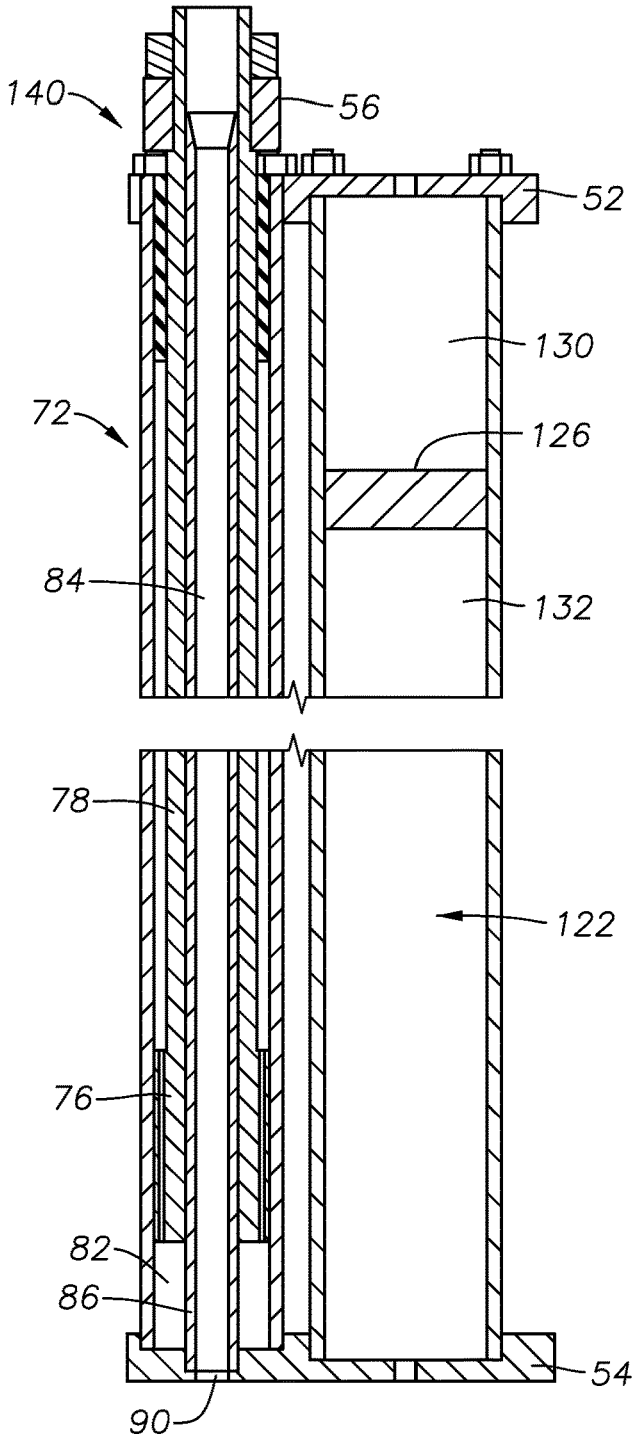
FIG. 7 is a cross-sectional side view of the cylinder assembly of FIG. 6.

The fluid moved between lower accumulator chamber 132 and lower balance chambers 38 and 50 may be a hydraulic fluid. In one embodiment, supply unit 134 contains one or more $N_2$ gas bottles and upper accumulator chamber 132 may be configured to hold $N_2$ gas. Alternatively, supply unit 134 may contain N2 gas or dry air. FIG. 7 is a side cross-sectional view of cylinder assembly 140 having accumulator cylinder 122 and drive cylinder 72 with axial bore 84 through drive rod 78, with sealing tubular 86 sealing axial bore 84.

Figure 8:
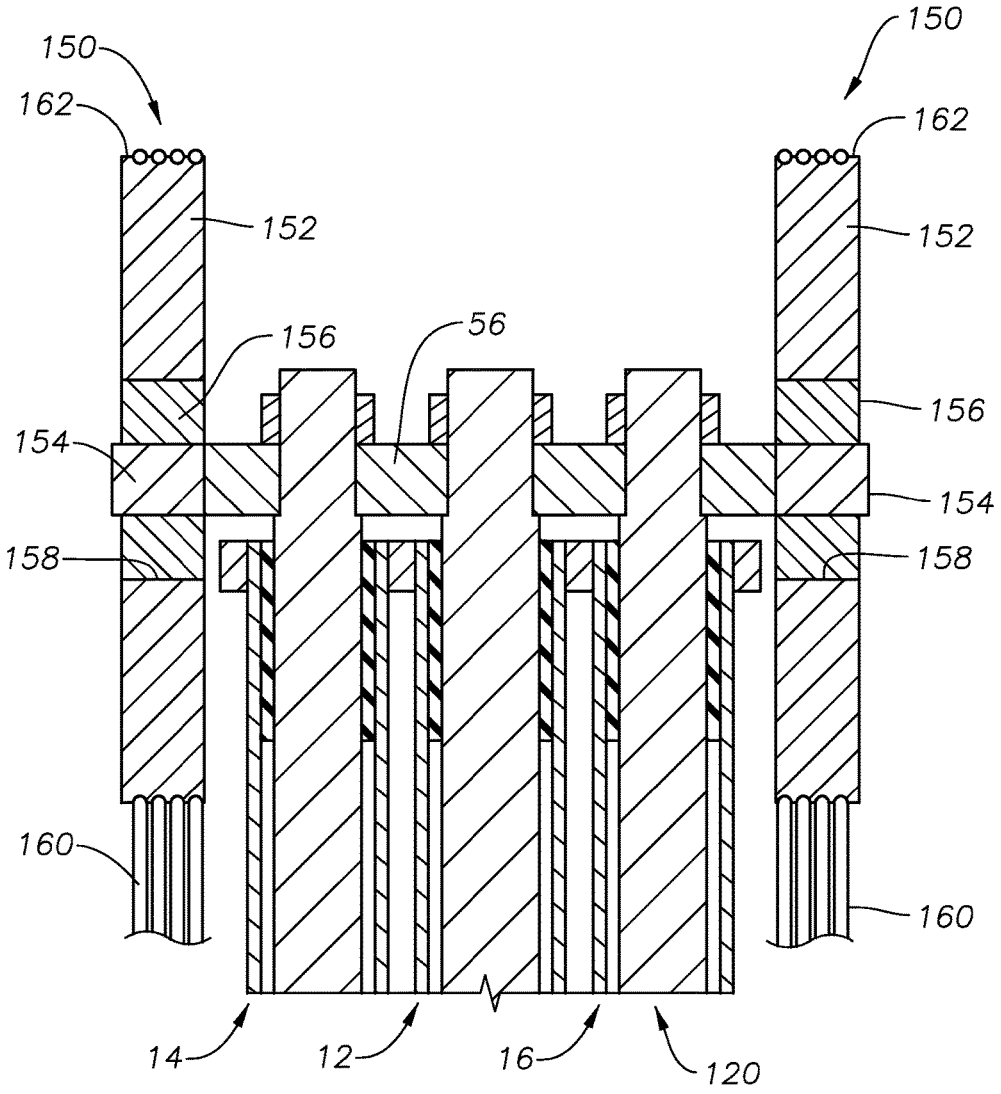
FIG. 8 is a partial cross-sectional view of a cylinder assembly and a sheave assembly of the pump jack system.
Figure 9:
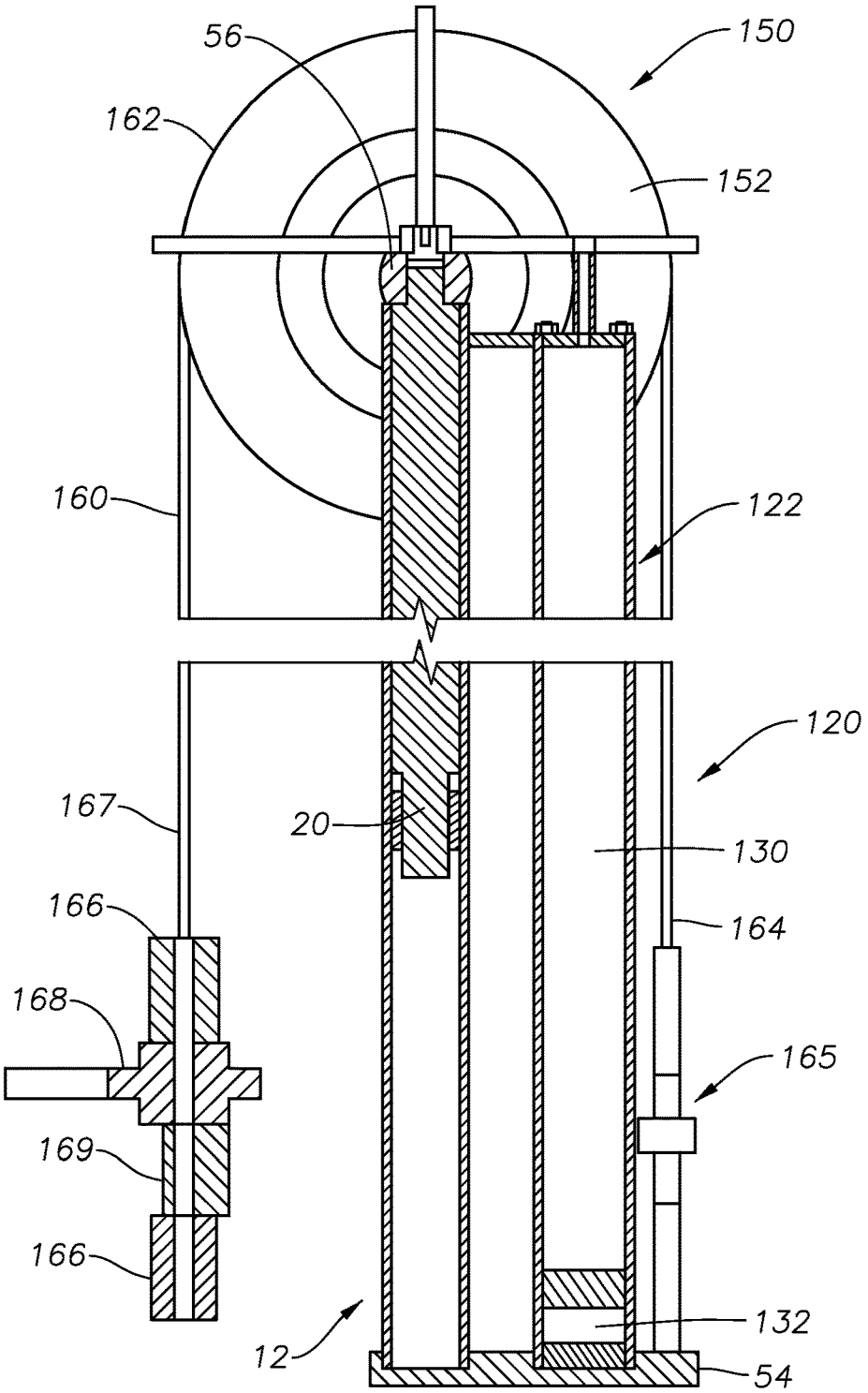
FIG. 9 is a cross-sectional view of the cylinder assembly and sheave assembly of the pump jack system.
Figure 10:
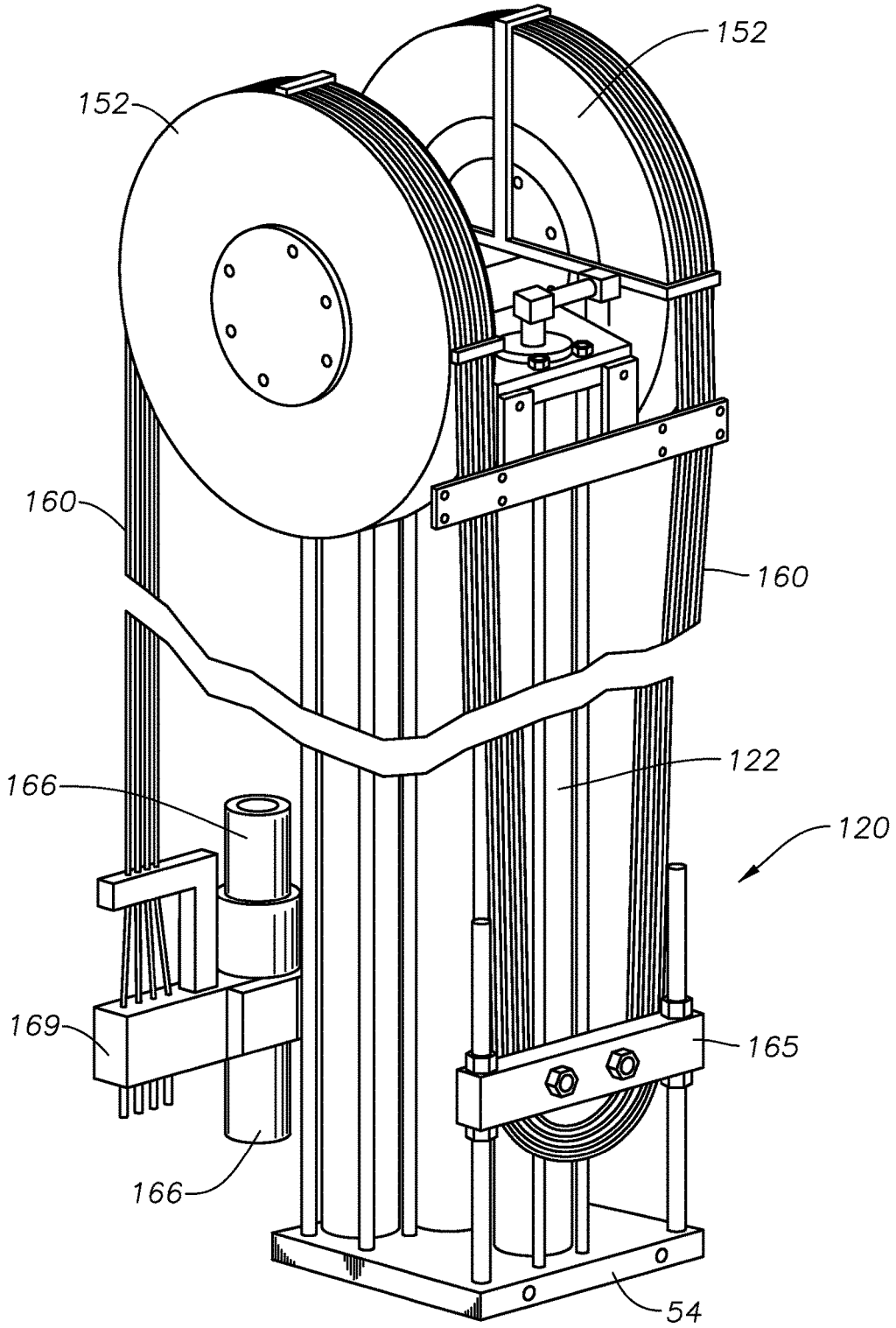
FIG. 10 is a perspective view of the cylinder assembly and sheave assembly.

Referring to FIGS. 8-10, two sheave assemblies 150 may be attached to cylinder assembly 120. Each sheave assembly 150 may include sheave 152 connected to rod cross member 56 of cylinder assembly 120. Sheave 152 may rotate about axis member 154, with bearing 156 disposed between aperture 158 of sheave 152 and axis member 154. Axis member 154 may be affixed to rod cross member 56, such as through threaded connection. Alternatively, sheave 152 may be directly connected to rod cross member 56 such that bearing 156 is disposed around an end of rod cross member 56. Wire line 160 may be disposed around circumferential surface 162 of sheave 152 and may extend down below either side of sheave 152. First end 164 of wire line 160 may be anchored to lower cross member 54. First end 164 may be anchored directly to lower cross member 54. Alternatively, first end 164 may be anchored to lower cross member 54 through anchor assembly 165. A carrier assembly including rod clamp members 166 may be attached to second end 167 of wire line 160. The carrier assembly may also include rod rotator member 168 and carrier member 169 attached between rod clamp members 166. In one embodiment, lower cross member 54 may include integrated flow lines for fluid connection between lower accumulator chamber 132 and lower balance chambers 38, 50.

As pistons 20, 30, 42 and rod cross member 56 move upward (as described above), sheave 152 and rod clamp members 166 are moved upward. Similarly, as pistons 20, 30, 42 and rod cross member 56 move downward, sheave 152 and rod clamp members 166 are moved downward. A single wire line 160 or multiple wire lines 160 may be disposed around each sheave 152. It should be noted that sheave assembly 150 may also be used with cylinder assembly 10, cylinder assembly 70, or cylinder assembly 140.

Figure 11:
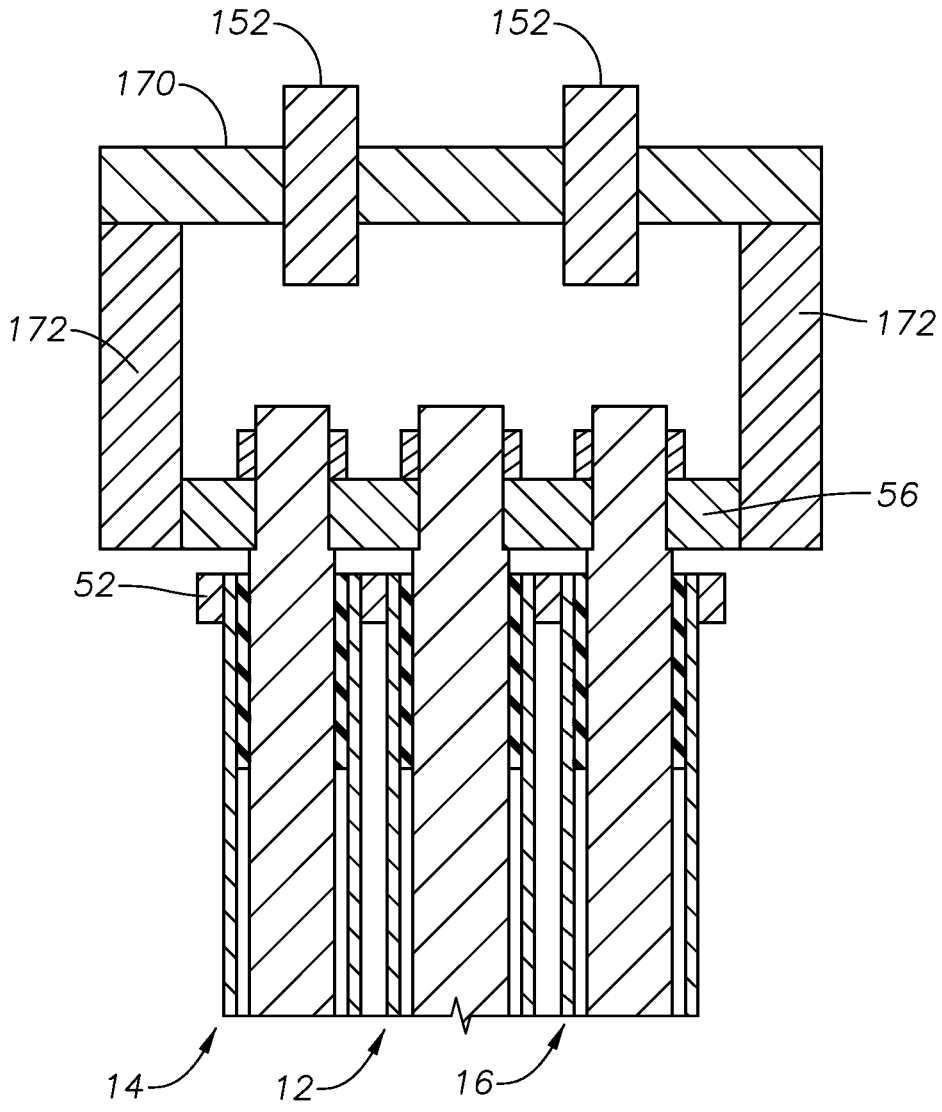
FIG. 11 is a partial cross-sectional view of an alternate embodiment of the cylinder assembly and sheave assembly.

FIG. 11 illustrates an alternative configuration for the connection of sheave 152 to rod cross member 56 of cylinder assembly 120. In this embodiment, each sheave 152 may be affixed to and rotate about sheave cross member 170, which is positioned above rod cross member 56. Side members 172 may secure both ends of rod cross member 56 to both ends of sheave cross member 170. The length of side members 172 may define the vertical separation between rod cross member 56 and sheave cross member 170.

Figure 12:
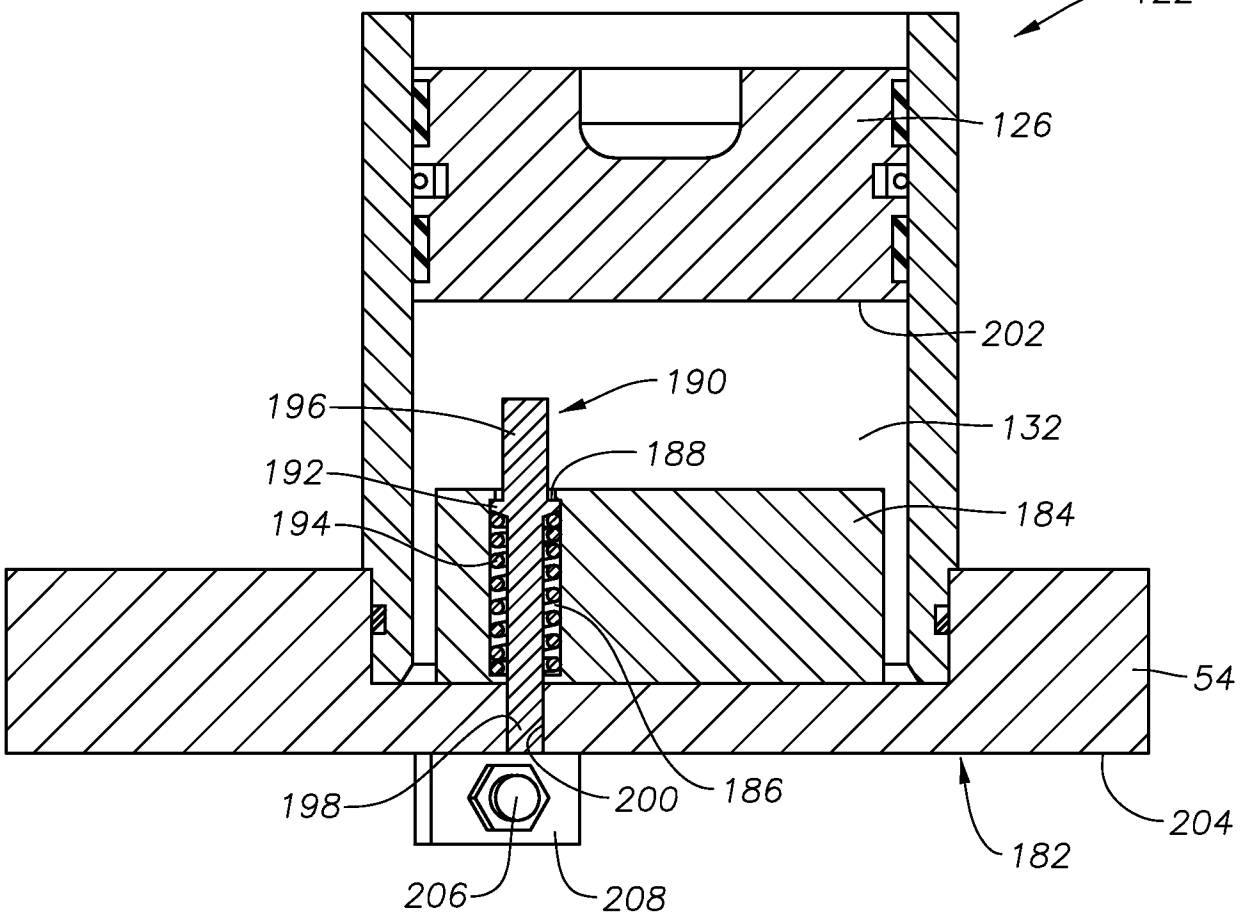
FIG. 12 is a leak detection system for the accumulator cylinder.

With reference now to FIGS. 9 and 12, leak detection system 182 may be configured to detect leaks in lower accumulator chamber 132 and lower balance chambers 38, 50, such as leaks across balance pistons 30, 42 or accumulator piston 126. Leak detection system 182 may be affixed to lower cross member 54 (or lower plate 180 in the embodiment shown in FIGS. 10-11) such that a portion of leak detection system 182 is disposed within lower accumulator chamber 132.

Leak detection system 182 may include base member 184 having aperture 186 with upper radial shoulder 188. Leak detection system 182 may also include ram member 190 having radial extension 192. Ram member 190 and spring member 194 may be disposed within aperture 186 of base member 184. Spring member 194 may bias radial extension 192 of ram member 190 in an upward direction, such that in a neutral position, radial extension 192 engages upper radial shoulder 188 of base member 184. In the neutral position, upper end 196 of ram member 190 may extend beyond base member 184 into accumulator chamber 132, and lower end 198 of ram member 190 may be disposed within aperture 200 of lower cross member 54.

If fluid is leaking from lower accumulator chamber 132 and/or lower balance chambers 38, 50, accumulator piston 126 will continue to move downward until lower surface 202 of accumulator piston 126 engages upper end 196 of ram member 190 and moves ram member 190 downward by compressing spring member 194. As ram member 190 moves downward, lower end 198 of ram member 190 extends beyond lower surface 204 of lower cross member 54, which is detected by proximate sensor 206 held below lower cross member 54 with sensor holder 208. In response, proximate sensor 206 may cause a control system to reset ram member 190 to the neutral position. An increase in the frequency of lower end 198 of ram member 190 extending beyond lower surface 204 of lower cross member 54 indicates a fluid leak from lower accumulator chamber 132 and/or lower balance chambers 38, 50. In response to detection of a leak, seals of these chambers may be inspected or replaced.

Figure 13:
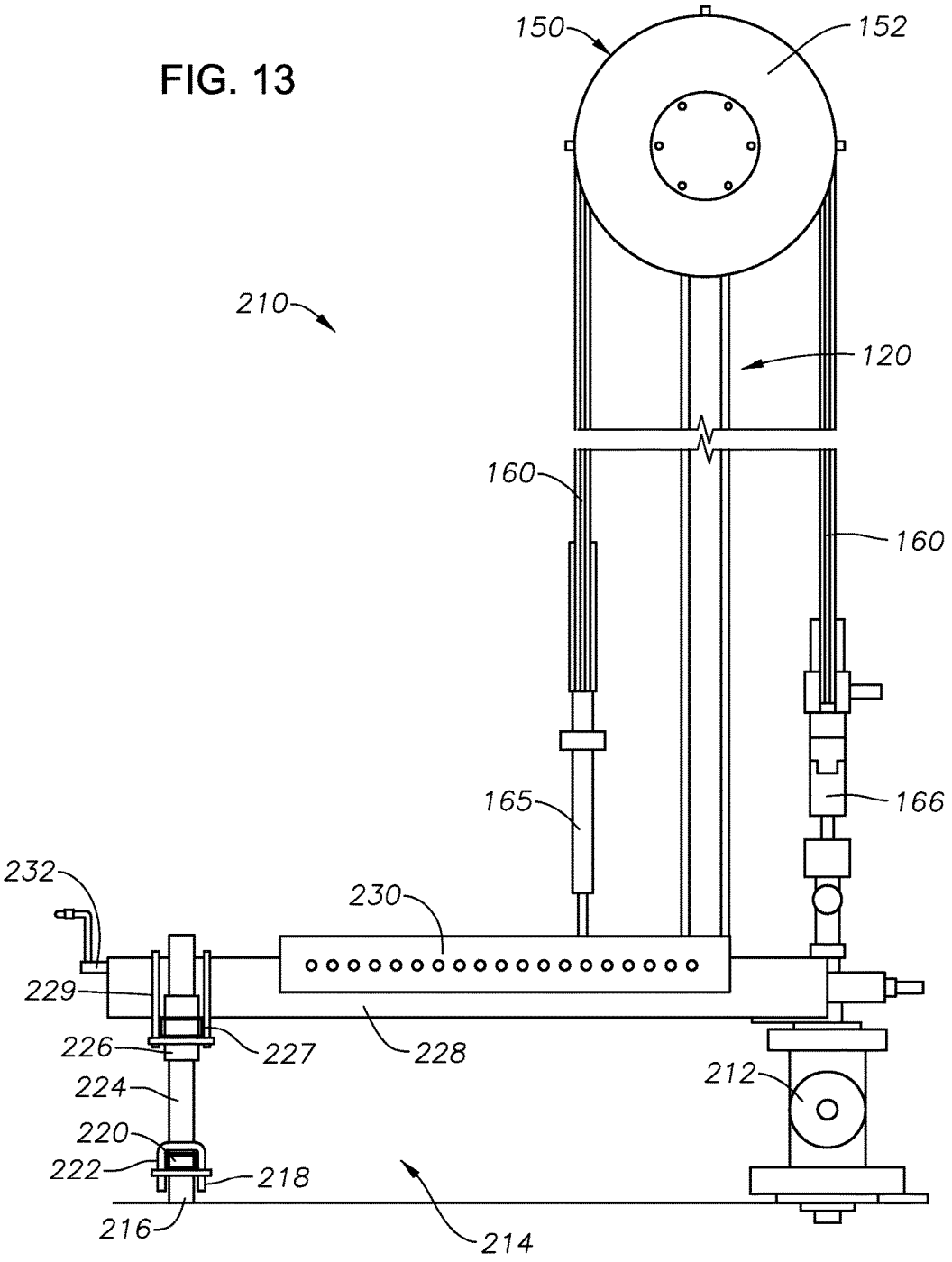
FIG. 13 is a side view of one embodiment of a side mount pump jack system.
Figure 14:
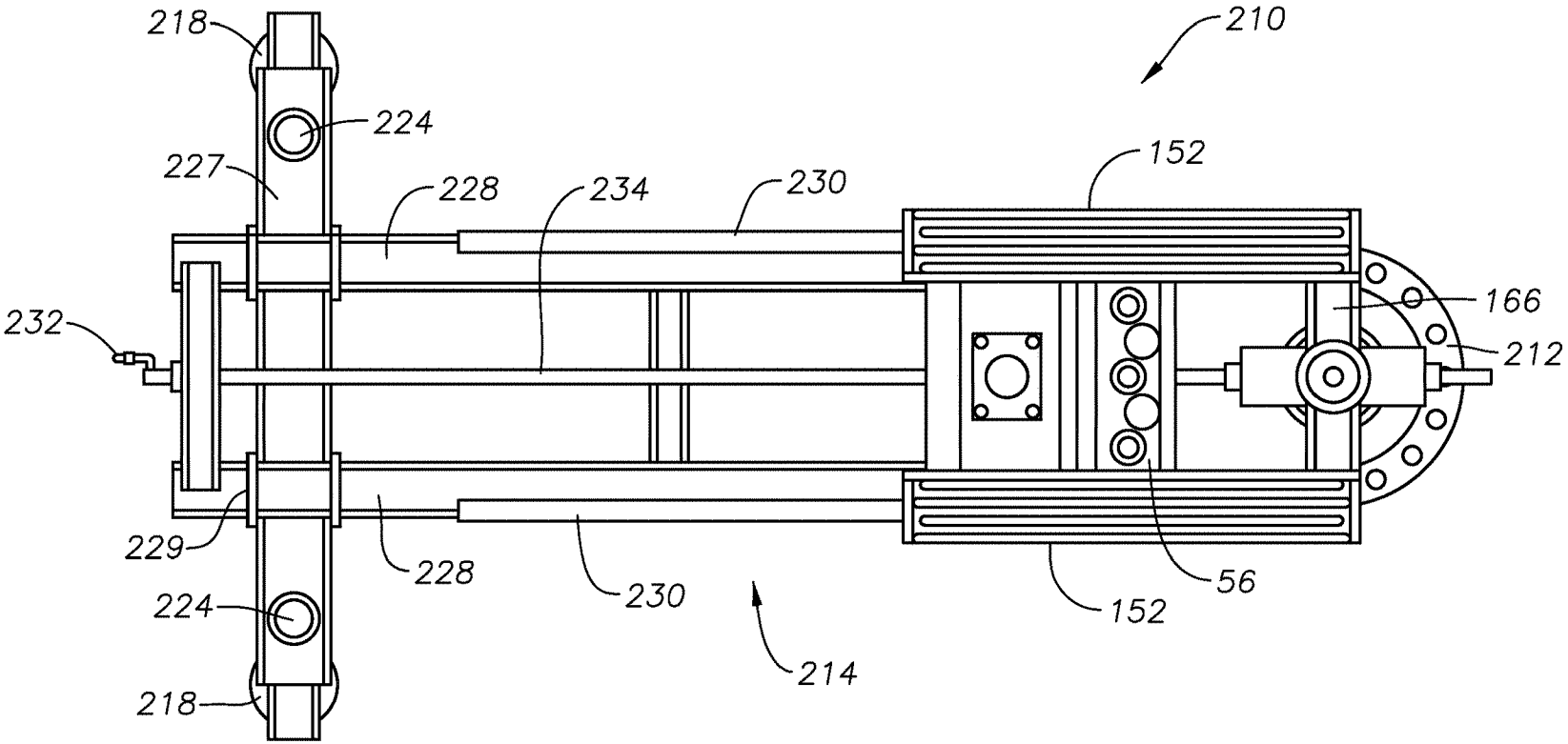
FIG. 14 is a top view of the side mount pump jack system.

FIGS. 13 and 14 illustrate pump jack system 210 including cylinder assembly 120 and sheave assemblies 150. Rod clamp members 166 may be disposed above wellhead 212, while frame assembly 214 may hold cylinder assembly 120 a horizontal distance from wellhead 212. Frame assembly 214 may two or more vertical support members and a horizontal support member interconnecting the vertical support members and the wellhead. Cylinder assembly 120 may be mounted on the horizontal support member. Frame assembly 214 may further include a mechanism for horizontally moving cylinder assembly 120 toward or away from wellhead 212. In one embodiment, the vertical support members may be formed of piles 216, each having attached flange 218. Cross beam 220 may interconnect flanges 218. U-bolts 222 may secure cross beam 220 to flanges 218. Vertical support pipe 224 may be attached to U-bolt 222 and screw collar 226. Vertical support pipe 224 may be threaded for raising or lowering the horizontal portion of frame assembly 214 based upon the height of wellhead 212. Upper cross beam 227 may be connected to each screw collar 226. Horizontal beams 228 may be connected to upper cross beam 227 through brace 229. Guide 230 may be affixed to horizontal beams 228. Crank 232 may be attached to screw member 234, which is positioned in a parallel arrangement with horizontal beams 228. Rotation of crank 232 about screw member 234 may move cylinder assembly 120 toward or away from wellhead 212. Alternatively, pump jack system 210 may include cylinder assembly 10.

With rod clamp members 166 in line with a center point of wellhead 212, rod clamp members 166 may be connected to sucker rod string 236. Sucker rod string 236 may extend through wellhead 212 and the associated oil and gas well to a downhole pump. Vertical reciprocation of sucker rod string 236 may power the downhole pump to allow for pumping fluid from the well to the surface. Pump jack system 210 may vertically reciprocate sucker rod string 236. Fluid may be fed into drive chamber 26 to raise drive piston 20, rod cross member 56, and sheaves 152. Fluid may be fed into lower balance chambers 38, 50 from an accumulator (e.g., a bladder accumulator or an accumulator cylinder) to provide counterbalance during the upstroke. Sheaves 152 may rotate as they are lifted such that the circumferential surface of sheaves 152 rotates along and takes up a length of wire line 160, which in turn lifts rod clamp members 166 and connected sucker rod string 236. Fluid may then be fed into upper balance chambers 36, 48 in order to lower balance pistons 30 and 42, rod cross member 56, and sheaves 150. Fluid may be returned from lower balance chambers 38, 50 to the accumulator. Sheaves 152 may rotate as they are lowered such that the circumferential surface of sheaves 152 rotates along and releases a length of wire line 160, which in turn lowers rod clamp members 166 and connected sucker rod string 236. This process is described in more detail above. In this way, pump jack system 210 may be used to vertically reciprocate a sucker rod string in order to power a downhole pump.

In one alternate embodiment, vertical support pipes 224 may be directly attached to a concrete block that is partially buried in the ground.

Figure 15:
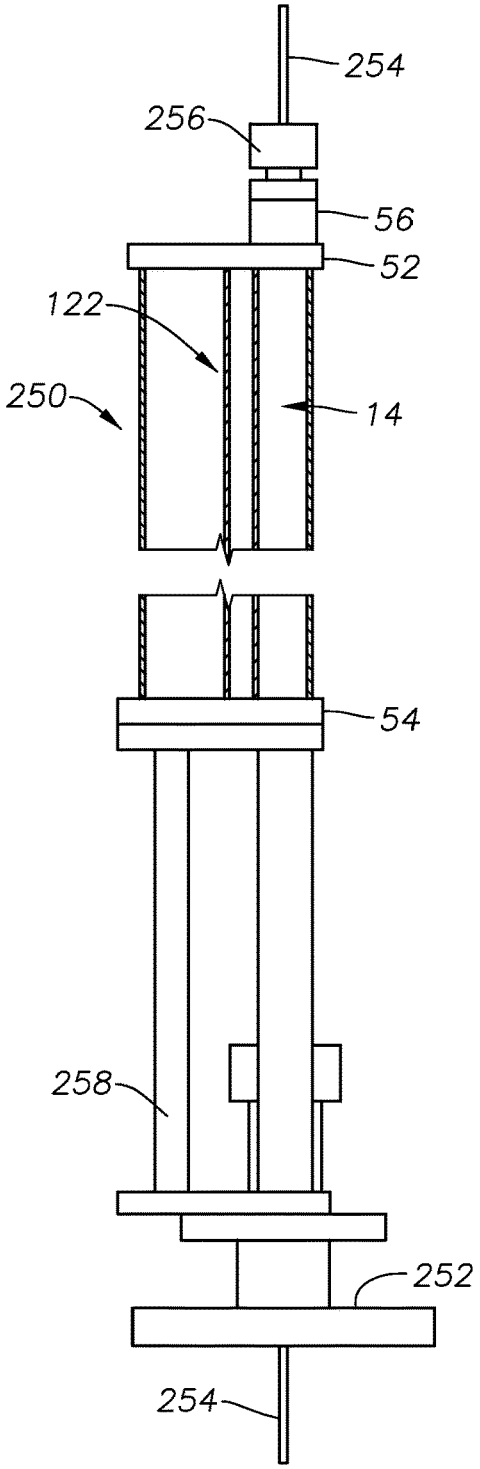
FIG. 15 is a side view of a direct mount pump jack system.

FIG. 15 illustrates pump jack system 250 including cylinder assembly 140 mounted directly above wellhead flange 252. More specifically, sealed bore 87 of drive cylinder 72 may be disposed directly above the wellhead. Sucker rod string 254 may extend through sealed bore 87 with an upper end of sucker rod string 254 rigidly connected to rod cross member 56 through sucker rod clamp 256. Lower cross member 54 may be supported by frame 258. Alternatively, pump jack system 250 may include cylinder assembly 70.

Sucker rod string 254 may extend below cylinder assembly 140, through wellhead flange 252, and into the oil and gas well below. A lower end of sucker rod string 254 may be in communication with a down hole pump. Vertical reciprocation of sucker rod string 254 may power the down hole pump for pumping fluid from the well to the surface. Pump jack system 250 may vertically reciprocate sucker rod string 254.

Fluid may be fed into drive chamber 82 to raise drive piston 76 and rod cross member 56, which in turn lifts sucker rod string 254 through sucker rod clamp 256. Fluid may be fed into lower balance chambers 38, 50 from an accumulator (e.g., a bladder accumulator or an accumulator cylinder) to provide counterbalance during the upstroke. Fluid may then be fed into upper balance chambers 36, 48 in order to lower balance pistons 30, 42 and rod cross member 56, which in turn lowers sucker rod string 254 through sucker rod clamp 256. Fluid may be returned from lower balance chambers 38, 50 to the accumulator. This process is described in more detail above. In this way, pump jack system 250 may be used to vertically reciprocate a sucker rod string in order to power a downhole pump.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A pump jack system for vertically reciprocating a downhole pump, the system comprising:

a drive cylinder including a drive barrel, a drive piston disposed within the drive barrel, and a drive rod with a lower end affixed to the drive piston, wherein the drive piston includes a fluid passage providing fluid communication across the drive piston within the drive barrel to create a single drive chamber within the drive barrel, wherein the drive cylinder includes only a single fluid port in fluid communication with the single drive chamber;

two balance cylinders positioned on either side of the drive cylinder, each balance cylinder including a balance barrel, a balance piston disposed within the balance barrel, and a balance rod with a lower end affixed to the balance piston, wherein an upper balance chamber and a lower balance chamber within each balance barrel are separated by each balance piston, wherein the lower balance chambers are in fluid communication;

an upper cross member operatively connecting an upper end of the drive barrel and an upper end of each of the balance barrels;

a lower cross member operatively connecting a lower end of the drive barrel and a lower end of each of the balance barrels; and a rod cross member operatively connecting an upper end of the drive rod and an upper end of each of the balance rods in a fixed configuration, wherein the rod cross member is configured for lifting the balance pistons upon upward movement of the drive piston when a fluid is pumped into the drive chamber through the single fluid port and for lowering the drive piston upon downward movement of the balance pistons when a fluid is pumped into the upper balance chambers.

2. The pump jack system of claim 1, wherein the rod cross member is configured for lowering the drive piston upon downward movement of the balance pistons.

3. The pump jack system of claim 1, wherein each of the two balance pistons includes an upper surface area, and wherein a lower surface area of the drive piston is approximately equal to the sum of the upper surface areas of the two balance pistons.

4. The pump jack system of claim 1, wherein the upper balance chambers are in fluid communication.

5. The pump jack system of claim 1, further comprising a drive seal and two balance seals, wherein the drive seal is disposed within an upper end of the drive barrel and around the drive rod for sealing the drive chamber, and wherein each balance seal is disposed within an upper end of the balance barrel and around the balance rod for sealing the balance chamber.

6. The pump jack system of claim 1, further comprising an axial bore through the drive piston and through the entire length of the drive rod, wherein the lower cross member includes an aperture in fluid communication with the axial bore, and wherein the axial bore and the aperture are dimensioned to receive a sucker rod string of a downhole pump.

7. The pump jack system of claim 6, further comprising a sealing tubular disposed through the axial bore, wherein a lower end of the sealing tubular is affixed to the lower cross member and the upper end of the sealing tubular is disposed within the axial bore in all positions of the drive piston to provide a fluid seal separating the axial bore from the drive chamber.

8. The pump jack system of claim 1, further comprising a sheave assembly including a sheave rotatably connected to the rod cross member, a wire rope disposed around a portion of a circumferential surface of the sheave with a first end of the wire rope anchored to the lower cross member, and a carrier member attached to a second end of the wire rope, wherein the carrier member is configured to engage a sucker rod string of the downhole pump.

9. The pump jack system of claim 8, further comprising a frame assembly for positioning the lower cross member a horizontal distance from a wellhead, the frame assembly including two or more vertical support members and a horizontal support member operatively interconnecting the vertical support members and the wellhead.

10. The pump jack system of claim 9, wherein the horizontal support member includes a transport assembly having a crank and a screw member for moving the lower cross member toward or away from the wellhead.

11. The pump jack system of claim 1, further comprising an accumulator in fluid communication with the lower balance chambers, wherein the accumulator is configured to maintain a relative constant fluid pressure in the lower balance chambers as the balance pistons are lifted and lowered.

12. The pump jack system of claim 11, wherein the accumulator includes a bladder accumulator.

13. The pump jack system of claim 11, wherein the accumulator includes an accumulator cylinder having an accumulator barrel, an accumulator piston disposed within the accumulator barrel, wherein an upper balance chamber and a lower balance chamber within the accumulator barrel are separated by the accumulator piston, wherein the lower accumulator chamber is in fluid communication with the lower balance chambers, and wherein the upper accumulator chamber is in fluid communication with a supply unit.

14. The pump jack system of claim 13, wherein an upper end of the accumulator barrel is operatively connected to the upper cross member and a lower end of the accumulator barrel is operatively connected to the lower cross member.

15. The pump jack system of claim 13, wherein the supply unit includes an $N_2$ gas bottle.

16. The pump jack system of claim 13, further comprising a leak detector operatively connected to the lower accumulator chamber, wherein the leak detector is configured to detect leaks from the lower accumulator chamber or the lower balance chambers.

17. The pump jack system of claim 16, wherein the leak detector includes a ram member biased by a spring member, the ram member configured to generate an alert when the accumulator piston contacts an upper end of the ram member.

18. The pump jack system of claim 17, wherein the leak detector further includes:

a base member disposed within the lower accumulator chamber along the lower cross member, the base member having an aperture and an upper radial shoulder, the aperture housing a portion of the ram member and the spring member, wherein the spring member biases a radial extension of the ram member in an upward direction;

wherein in a neutral position the radial extension of the ram member engages the upper radial shoulder of the base member, an upper end of the ram member extends beyond the upper radial shoulder into the lower accumulator chamber, and a lower end of the ram member is disposed within an aperture through the lower cross member; and wherein in an alert position the lower end of the ram member extends beyond a lower surface of the lower cross member.

19. The pump jack system of claim 1, further comprising one or more tie rods interconnecting the upper cross member and the lower cross member.

20. A method of reciprocating a downhole pump in a wellbore, comprising the steps of:

a) providing a pump jack system comprising: a drive cylinder including a drive barrel, a drive piston disposed within the drive barrel, and a drive rod with a lower end affixed to the drive piston, wherein the drive piston includes a fluid passage providing fluid communication across the drive piston within the drive barrel to create a single drive chamber within the drive barrel, and wherein an axial bore extends through the drive piston and through the entire length of the drive rod; two balance cylinders positioned on either side of the drive cylinder, each balance cylinder including a balance barrel, a balance piston disposed within the balance barrel, and a balance rod with a lower end affixed to the balance piston, wherein an upper balance chamber and a lower balance chamber within each balance barrel are separated by each balance piston, wherein the lower balance chambers are in fluid communication; an upper cross member operatively connecting an upper end of the drive barrel and an upper end of each of the balance barrels; a lower cross member operatively connecting a lower end of the drive barrel and a lower end of each of the balance barrels, wherein the lower cross member includes an aperture in fluid communication with the axial bore through the drive rod and drive piston; a rod cross member operatively connecting an upper end of the drive rod and an upper end of each of the balance rods in a fixed configuration, wherein the rod cross member is configured for lifting the balance pistons upon upward movement of the drive piston, and wherein the rod cross member is configured for lowering the drive piston upon downward movement of the balance pistons;

b) positioning the pump jack system at a wellbore site such that the drive cylinder is disposed above the wellbore with the axial bore of the drive piston and drive rod in fluid communication with a wellhead;

c) running a sucker rod string of a downhole pump through the wellhead and through the aperture of the lower cross member and the axial bore of the drive piston and drive rod, and attaching an upper end of the sucker rod string to the rod cross member with a clamp;

d) lifting the sucker rod string by pumping a first fluid into the drive chamber thereby lifting the drive piston, the rod cross member, and the balance pistons;

e) counterbalancing the lifting of the drive piston by drawing a second fluid into the lower balance chambers as the balance pistons are lifted;

f) lowering the sucker rod string by pumping a third fluid into the upper balance chambers thereby lowering the balance pistons, the rod cross member, and the drive piston.

21. The method of claim 20, wherein the pump jack system further comprises an accumulator in fluid communication with the lower balance chambers, and wherein step (e) further comprises drawing the second fluid from the accumulator into the lower balance chambers to maintain a relative constant fluid pressure in the lower balance chambers as the balance pistons are lifted.

22. The method of claim 21, further comprising the steps of:

g) counterbalancing the lowering of the rod cross member by collecting the second fluid from the lower balance chambers in the accumulator as the balance pistons are lowered.

23. The method of claim 20, wherein the first fluid, the second fluid, and the third fluid consist of a hydraulic fluid.

24. A method of reciprocating a downhole pump in a wellbore, comprising the steps of:

a) providing a pump jack system comprising: a drive cylinder including a drive barrel, a drive piston disposed within the drive barrel, and a drive rod with a lower end affixed to the drive piston, wherein the drive piston includes a fluid passage providing fluid communication across the drive piston within the drive barrel to create a single drive chamber within the drive barrel; two balance cylinders positioned on either side of the drive cylinder, each balance cylinder including a balance barrel, a balance piston disposed within the balance barrel, and a balance rod with a lower end affixed to the balance piston, wherein an upper balance chamber and a lower balance chamber within each balance barrel are separated by each balance piston, wherein the lower balance chambers are in fluid communication; an upper cross member operatively connecting an upper end of the drive barrel and an upper end of each of the balance barrels; a lower cross member operatively connecting a lower end of the drive barrel and a lower end of each of the balance barrels; a rod cross member operatively connecting an upper end of the drive rod and an upper end of each of the balance rods in a fixed configuration, wherein the rod cross member is configured for lifting the balance pistons upon upward movement of the drive piston, and wherein the rod cross member is configured for lowering the drive piston upon downward movement of the balance pistons; a sheave assembly including a sheave rotatably connected to the rod cross member, a wire rope disposed around a portion of a circumferential surface of the sheave with a first end of the wire rope anchored to the lower cross member, and a carrier member attached to a second end of the wire rope;

b) positioning the pump jack system at a wellbore site such that the carrier member is disposed above a wellhead of the wellbore c) attaching an upper end of a sucker rod string of a downhole pump to the carrier member;

d) lifting the sucker rod string by pumping a first fluid into the drive chamber thereby lifting the drive piston, the rod cross member, the balance pistons, the sheave, and the carrier member;

e) counterbalancing the lifting of the drive piston by drawing a second fluid into the lower balance chambers as the balance pistons are lifted;

f) lowering the sucker rod string by pumping a third fluid into the upper balance chambers thereby lowering the balance pistons, the rod cross member, the drive piston, the sheave, and the carrier member.

25. The method of claim 24, wherein the pump jack system further comprises an accumulator in fluid communication with the lower balance chambers, and wherein step (e) further comprises drawing the second fluid from the accumulator into the lower balance chambers to maintain a relative constant fluid pressure in the lower balance chambers as the balance pistons are lifted.

26. The method of claim 25, further comprising the steps of:

g) counterbalancing the lowering of the rod cross member by collecting the second fluid from the lower balance chambers in the accumulator as the balance pistons are lowered.

27. The method of claim 24, wherein the first fluid, the second fluid, and the third fluid consist of a hydraulic fluid.

* * * * *